US010159368B2

(12) United States Patent
Lin

(10) Patent No.: US 10,159,368 B2
(45) Date of Patent: Dec. 25, 2018

(54) MULTIFUNCTIONAL MUG CAP WITH A SIPPER AND STRAW

(71) Applicant: Shin-Shuoh Lin, Laguna Hills, CA (US)

(72) Inventor: Shin-Shuoh Lin, Laguna Hills, CA (US)

( * ) Notice: Subject to any disclaimer, the term of this patent is extended or adjusted under 35 U.S.C. 154(b) by 0 days.

(21) Appl. No.: 15/597,644

(22) Filed: May 17, 2017

(65) Prior Publication Data

US 2018/0332987 A1 Nov. 22, 2018

(51) Int. Cl.
*A47G 19/22* (2006.01)
*B65D 51/18* (2006.01)
(Continued)

(52) U.S. Cl.
CPC ..... *A47G 19/2272* (2013.01); *A47G 21/18* (2013.01); *B65D 43/0225* (2013.01);
(Continued)

(58) Field of Classification Search
CPC ..... A47G 19/2272; A47G 21/18; B65D 43/0225; B65D 43/16; B65D 51/18;
(Continued)

(56) References Cited

U.S. PATENT DOCUMENTS 5,244,113 A * 9/1993 Stymiest ..... B65D 51/242 215/228

7,059,490 B2 * 6/2006 Son ..... B65D 25/465 220/254.3

(Continued)

*Primary Examiner* — J. Gregory Pickett
*Assistant Examiner* — Niki M Eloshway
(74) *Attorney, Agent, or Firm* — Alexander Chen, Esq.; Agnew International Patent & Trademark Law Firm

(57) ABSTRACT

A tumbler apparatus comprising a mug cap and a tumbler wherein the mug cap comprises a cylindrical section having an upper section and a lower section wherein the lower section comprises male threads along its outer perimeter and the tumbler having female threads along its inner perimeter and further comprises a lower straw apparatus; the lower straw apparatus comprises an opening and a straw attached to the opening; the top section comprises a primary opening and a sipper opening, a top half straw apparatus, a leveler and a lid; the lid is comprised of a protruding tab and a base, the lid's base is attached to the perimeter of the primary opening providing a pivot for the lid switch between close and open configurations and when in closed configuration the protruding tab seals the sipper opening; the top straw apparatus comprising a cylindrical body with a hallow section inside the cylindrical body having a first opening near its proximal end and a second opening near its distal end; an attachment device near its proximal end where the attachment device attaches the top straw apparatus to the primary opening and provides pivot for the top straw apparatus to switch between close and open configuration wherein when the top straw apparatus is in its open configuration its first opening match to the opening of the lower straw apparatus and wherein when the top straw apparatus is in its closed configuration neither its first or second openings match the opening of the lower straw.

1 Claim, 5 Drawing Sheets

(51) Int. Cl.

| | |
|---|---|
| ***B65D 47/06*** | (2006.01) |
| ***A47G 21/18*** | (2006.01) |
| ***B65D 53/02*** | (2006.01) |
| ***B65D 43/02*** | (2006.01) |
| ***B65D 43/16*** | (2006.01) |

(52) U.S. Cl.
CPC ..... *B65D 43/16* (2013.01); *B65D 47/065* (2013.01); *B65D 51/18* (2013.01); *B65D 53/02* (2013.01); *B65D 2251/009* (2013.01); *B65D 2251/0021* (2013.01); *B65D 2251/0028* (2013.01); *B65D 2251/0081* (2013.01); *B65D 2543/00046* (2013.01)

(58) Field of Classification Search
CPC ..... B65D 53/02; B65D 2251/0021; B65D 2251/0028; B65D 2251/0081; B65D 2251/009; B65D 2543/00046
USPC ..... 220/254.3, 705, 707, 713, 714, 254.2
See application file for complete search history.

(56) References Cited

U.S. PATENT DOCUMENTS

| | | | | |
|---|---|---|---|---|
| 7,931,166 | B2 * | 4/2011 | Cuocolo, Jr. ..... | B65D 47/0847 220/254.2 |
| 8,672,174 | B1 * | 3/2014 | McMullin ..... | A47G 21/18 215/229 |
| 2003/0168455 | A1 * | 9/2003 | Zettle ..... | B65D 47/0895 220/254.3 |
| 2005/0092754 | A1 * | 5/2005 | Marsden ..... | A47G 19/2272 220/521 |
| 2010/0102060 | A1 * | 4/2010 | Ruse, Jr. ..... | B65D 43/0204 220/254.9 |
| 2015/0173539 | A1 * | 6/2015 | Mason ..... | A47G 19/2272 220/707 |
| 2015/0201773 | A1 * | 7/2015 | Sorensen ..... | A47J 43/27 220/254.5 |
| 2017/0253396 | A1 * | 9/2017 | Coon ..... | B65D 47/0866 |
| 2017/0273484 | A1 * | 9/2017 | Spivey ..... | A47G 19/2288 |

* cited by examiner

MULTIFUNCTIONAL MUG CAP WITH A SIPPER AND STRAW

FIELD OF THE INVENTION

The present invention relates to beverage containers, and, more specifically, to making a convenient, multifunctional mug cap with both a sipper and straw.

BACKGROUND OF THE INVENTION

As people get busier, they want to bring their favorite drink when they are commuting. They also want to keep their beverages warmer or colder longer so they can get the best tastes. These desires have been met with a vacuum mug, or thermal mug, that insulates the beverage inside from the temperature outside, and has become a modern convenience that busy people and commuters cannot function without. The more convenient and functional vacuum mugs get, the more often and more people use them. In recent years, among other changes, vacuum mug caps are improved substantially and provide more utilities.

For example, a vacuum mug with a stopper or screw cap that has a strainer or infuser attached to the underside of the cap, and an opening for sipping has allowed a coffee or tea drinker to brew her coffee or tea on the go as if the user takes a brewing pot with her, and enjoy the brew. The vacuum mug keeps the hot water hot, so the coffee or tea in the strainer or infuser has time to brew while the user travels to the workplace. With the sipper opening separate from that of the strainer or infuser, the user does not have to wait until arriving at the office to enjoy the beverage. She can enjoy the beverage while driving without removing the strainer or infuser.

Since a vacuum mug can keep both cold and hot beverage colder or warmer, respectively, longer than without one, a user can perhaps use it for hot coffee or tea in the morning and cold soda in the afternoon. In this use scenario, however, the user needs a versatile mug that lets her sip the hot coffee or tea, and gulp cold beverage without removing the cap. Currently, no mugs on the market offered this versatility. A user can only buy a mug for sipping hot coffee or tea, and another mug for gulping cold beverage. Alternatively, she has to remove the cap for gulping cold beverage, giving up the insulation benefits of the vacuum mug, and also risking a spillage.

Therefore, it is desirable to have a spill-proof and versatile cap to increase the utility of a vacuum mug.

OBJECT OF THE INVENTION

Accordingly, it is the object of this invention to create a vacuum mug that is versatile, multi-functional, and, thus, increases its utility.

It is the object of this invention to create a vacuum mug that lets the user sip hot beverage without removing the protective cap.

It is the object of this invention to create a vacuum mug that lets the user gulp cold beverage without removing the protective cap.

It is an object of the invention to create a vacuum mug that can withstands hot beverage.

It is an object of the invention to create a vacuum mug that can withstands cold beverage.

It is an object of the invention to create a vacuum mug cap that is spill-proof and versatile.

It is an object of the invention to create a vacuum mug with a cap that fits a coffee or tea POD machine, and receives beverage refilling without removing the cap.

SUMMARY OF INVENTION

In one aspect of the invention, a tumbler apparatus comprising a mug cap and a tumbler wherein the mug cap is disclosed which comprises a cylindrical section having an upper section and a lower section wherein the lower section comprises male threads along its outer perimeter and the tumbler having female threads along its inner perimeter and further comprises a lower straw apparatus; the lower straw apparatus comprises an opening and a straw attached to the opening; the top section comprises a primary opening and a sipper opening, a top half straw apparatus, a leveler and a lid; the lid is comprised of a protruding tab and a base, the lid's base is attached to the perimeter of the primary opening providing a pivot for the lid switch between close and open configurations and when in closed configuration the protruding tab seals the sipper opening; the top straw apparatus comprising a cylindrical body with a hallow section inside the cylindrical body having a first opening near its proximal end and a second opening near its distal end; an attachment device near its proximal end where the attachment device attaches the top straw apparatus to the primary opening and provides pivot for the top straw apparatus to switch between close and open configuration wherein when the top straw apparatus is in its open configuration its first opening match to the opening of the lower straw apparatus and wherein when the top straw apparatus is in its closed configuration neither its first or second openings match the opening of the lower straw.

BRIEF DESCRIPTION OF THE DRAWINGS

These and other features and advantages of the invention will not be described with reference to the drawings of certain preferred embodiments, which are intended to illustrate and not to limit the invention, and in which.

DETAILED DESCRIPTION OF THE INVENTION

Some embodiments are described in detail with reference to the related drawings. Additional embodiments, features, and/or advantages will become apparent from the ensuing description or may be learned by practicing the invention. The following description is not to be taken in a limiting sense, but is made merely for the purpose of describing the general principles of the invention. The steps described herein for performing methods form one embodiment of the invention, and, unless otherwise indicated, not all of the steps must necessarily be performed to practice the invention, nor must the steps necessarily be performed in the order listed. It should be noted that references to "an" or "one" or "some" embodiment(s) in this disclosure are not necessarily to the same embodiment, and such references mean at least one.

The present invention has been conceived with the aim of addressing one or more of the current vacuum mug caps' limitations. More specifically, the present invention is directed to a multifunctional mug cap that is spill-proof, versatile, and multi-functional to solve the current limitations.

Figure 1:
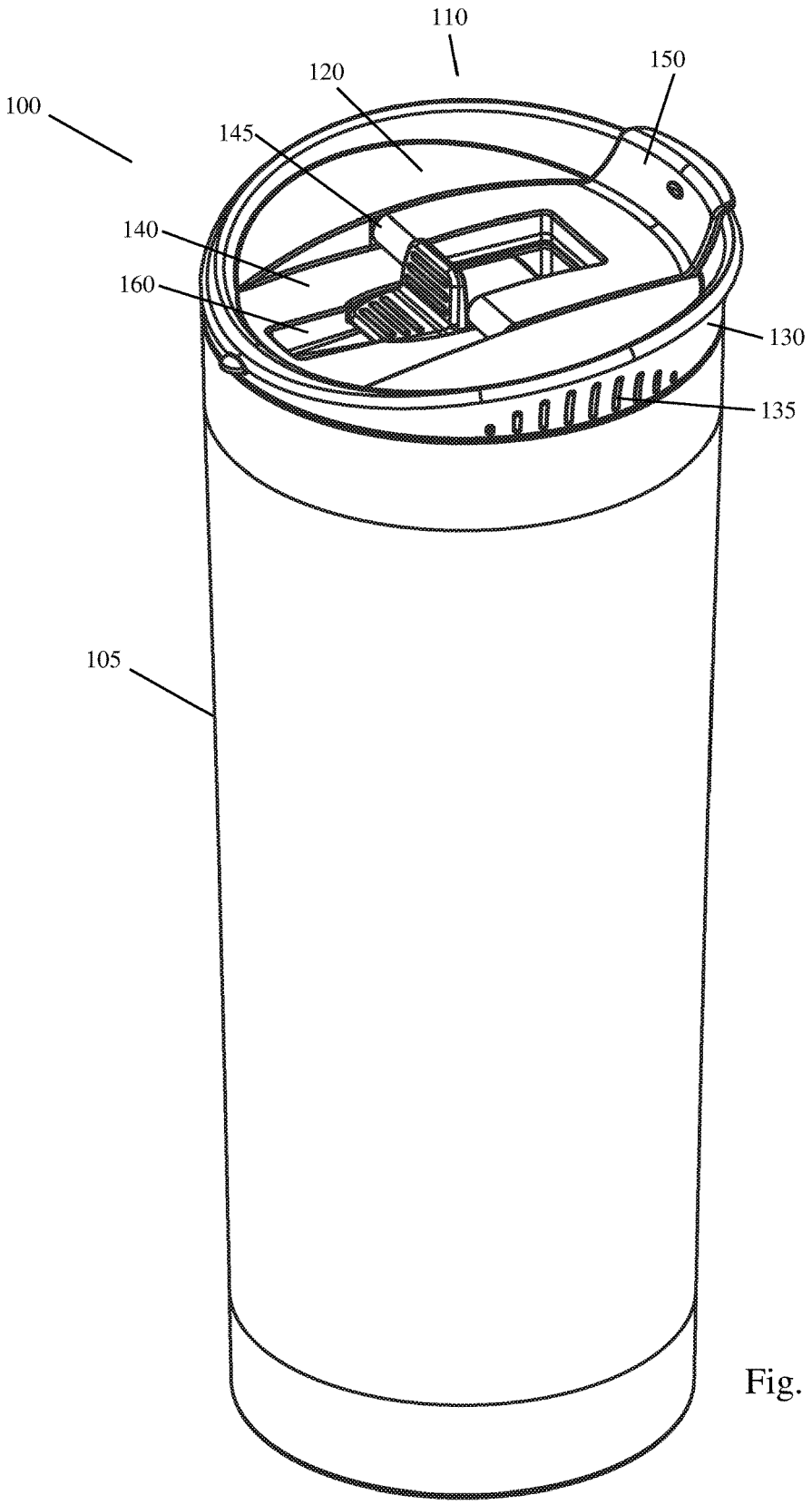
FIG. 1 is a perspective view of a multifunctional mug cap, fully assembled and in a closed position.

Referring to FIG. 1, in this embodiment, a mug 100 is shown fully assembled, closed and spill-proof. The mug 100 comprises a tumbler 105 and a screw cap 110. The round screw cap 110 comprises a top 120, whose rim is raised up above the top to form a hollow cylindrical segment 130 with the round top 120 being the bottom of the cylindrical segment. The open top of the cylindrical segment is slanted and has an elliptical shape. The cap 110 further comprises molded non-slip ribs 135 on the outer wall of the hollow cylindrical segment 130 by the co-vertexes of the elliptical top opening. The top 120 has a recess 140 positioned centrally and parallel with the major axis of the elliptical top opening, from rim to rim of the top 120, contained within the cylindrical segment 130. About the midway of the recess, on the inside walls, there are recesses to receive a pen of a hole-and-pen hinge 145, upon which a U-shape lid 150 can swing from the one half of the recess 140 to the other half. Obviously, the arch of the lid's edge, which is the bottom of the U, equals the arches of the recess 140 and, thus, that of the round cap 110, for the lid 150 to fit snugly in the recess 140. Where it meets the inner wall of the cylindrical segment 130, the edge of the lid 150 is extended upward as high as the wall. Then, the edge of the lid forms a groove to snugly fit the ring rim of the cylindrical segment 130. The tips of the two sides of the U-shaped lid are the shoulders of the lid 150, each of which has an elongated horizontal recess, parallel with the lid's top, open to the vertical outer walls to receive the pen of the hole-and-pen hinge 145. This shoulder recess is the counterpart of the recess on the inside wall of the recess 140, disclosed. Together, the counterpart recesses and pin pens form the hole-and-pen hinge 145 for the lid 150. The middle gap between the sides of the U-shaped lid matches the width of a smaller inner recess 160 at the bottom of the outer recess 140. The small inner recess 160 receives the top half of a straw, not shown in this figure, such that when the straw is not in use, it is positioned lying horizontally inside the recess 160, flush with the bottom of the larger recess 140. In FIG. 1, the lid 150 is in the closed position where the sipper opening is not open.

Figure 2:
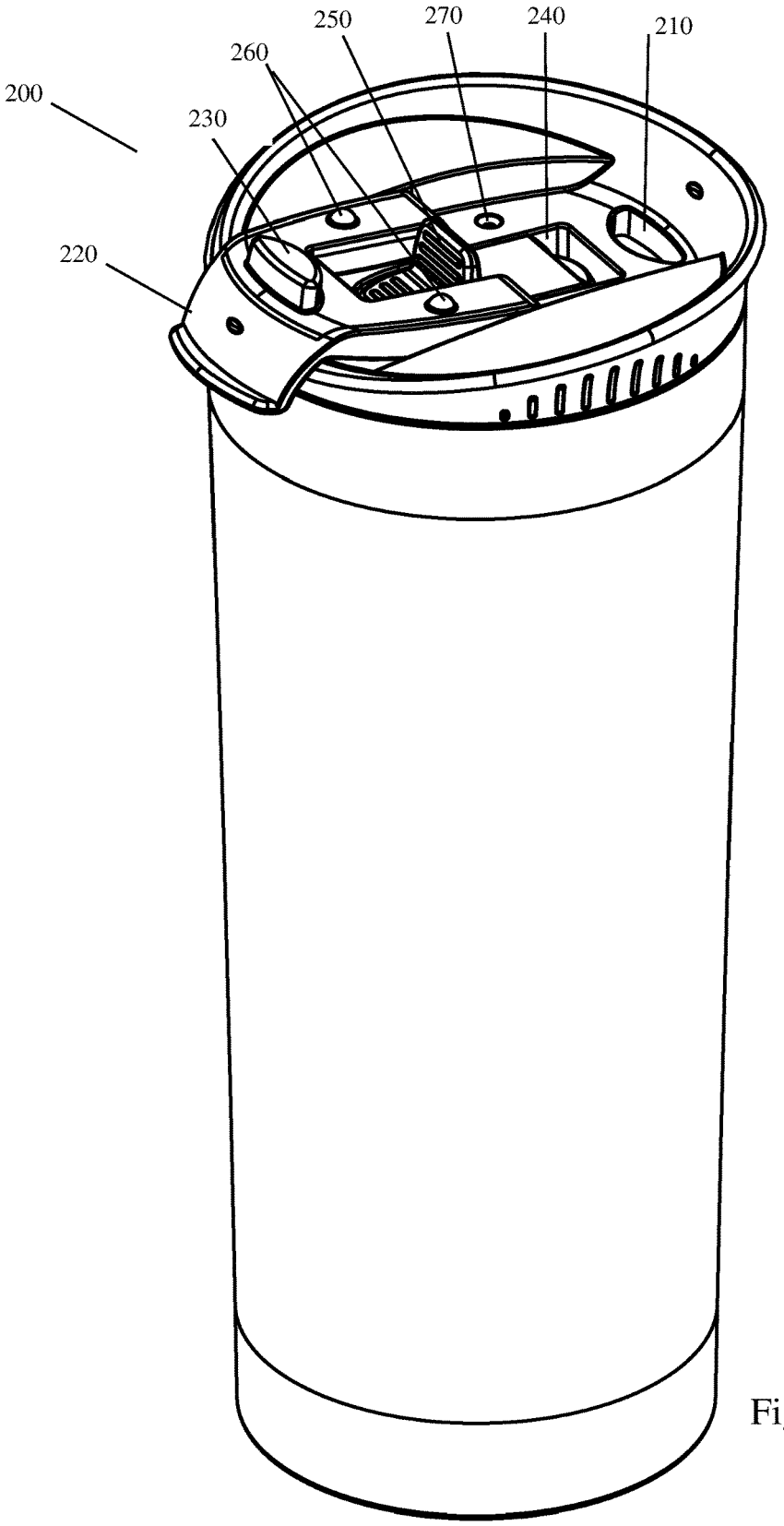
FIG. 2 is a perspective view of a multifunctional mug cap, fully assembled with its sipper opening open.

Referring to FIG. 2, in this embodiment, a mug 200 is shown fully assembled, with the sipper opening 210 open. The U-shaped lid 220 is flipped to the other half of the recess upon a hole-and-pen hinge positioned about the center of the cap's top. In this position, the lid 220 shows its bottom, and its protruding tab 230, usually made of silicone, that is used to plug the sipper opening 210. It is appreciated that other materials can be used besides silicone. In this position of the lid, the sipper opening 210 is open to let the beverage flow through when the mug is tipped. Also, in this position, the lid covers the top half of the straw, which is not shown in this figure, and prevents it from being used. The straw is not shown in this figure because it is lying down horizontally hidden under the U-shaped lid and inside the inner recess 240 of the cap. Also partially hidden in the smaller inner recess is a lever 250, whose utilities will be disclosed in the next section. Besides the silicone plug 230, there are two smaller buttons 260, usually made of silicone or rubber, on the bottoms of the left and right sides of the U-shaped lid 220. On the bottom of the larger outer recess of the cap top, there are two matching recesses 270 to receive the two buttons. Together the silicone plug 230 and the two silicone buttons 260 provide a strong grasp onto the cap top, lock the lid tightly down, and prevent accidental spillage.

Figure 3:
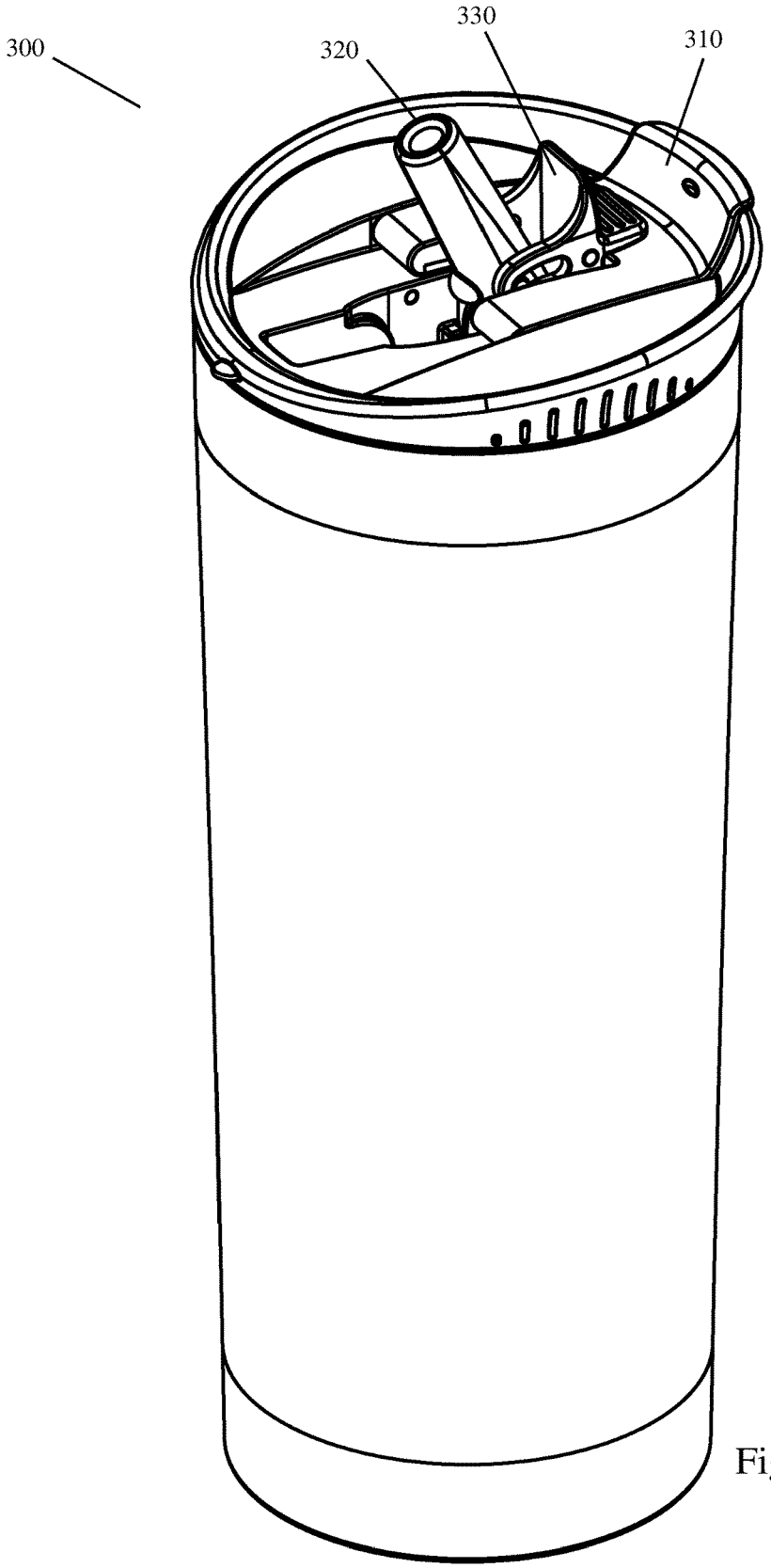
FIG. 3 is a perspective view of a multifunctional mug cap, fully assembled with its straw open.

Referring to FIG. 3, in this embodiment, mug 300 is shown fully assembled, with the straw being in use, and the sipper opening closed. The lid 310 is pressed down, and its protruding tab on its bottom plugs the sipper opening, not shown in this figure because it is under and covered by the lid 310. In the position, the top half 320 of the built-in straw is elevated up and the lower opening end of the top half 320 is obviously aligned with the top opening of the bottom half of the built-in straw, which is not shown in this figure because it is disposed inside the tumbler under the cap. As disclosed foregoingly, when not in use, the top half 320 of the built-in straw is lying down hidden inside the smaller inner recess on the cap's top. Thus, to elevate it up out of the inner recess for a use, the mug cap further comprises a lever 330, that swings on a hole-and-pen hinge disposed about the center of the inner recess, and lifts the top half of the straw with a pin-in-a-slot mechanism. The lever 330 comprises an L-shaped component, having two sides with molded non-slip ribs on the inside, and its back mounted on top a component shaped like a whistle having only the top and side walls. On these two side walls, there are two elongated and slightly curved slots disposed vertically, whose ends engage a pair of protruding tabs, or pins, disposed on the sides of the top half 320 of the straw, and as the lever 330 swings between open and closed positions of the straw, the slots move about a quadrant up and down, respectively, and engage the side pins of the top half 320 on their paths, and, then, pull and move them along, and, thus, lift up or push down, respectively, the straw's top half 320.

Figure 4:
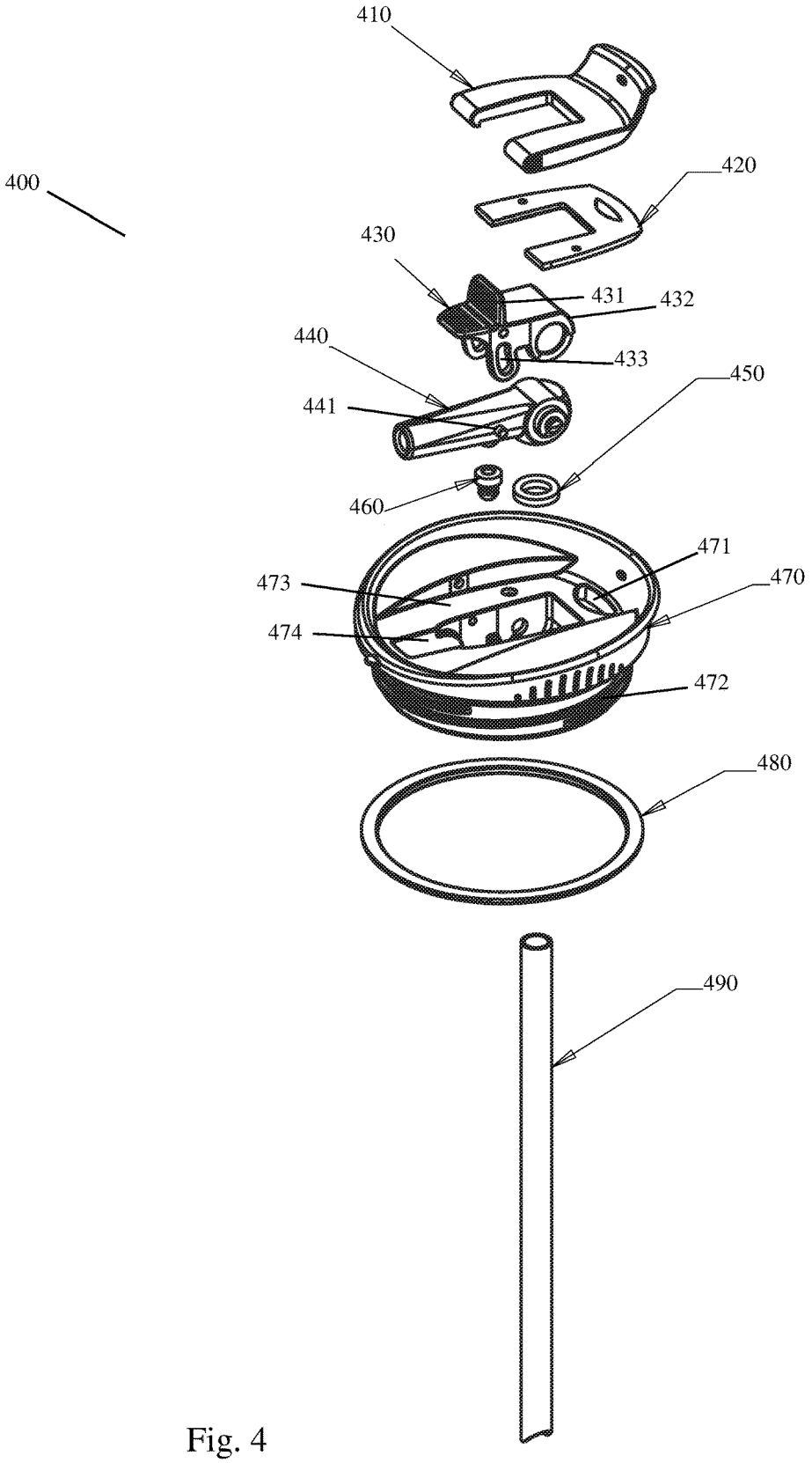
FIG. 4 is an exploded view of an exemplary multifunctional mug cap.

Referring to FIG. 4, an exploded view of an exemplary mug cap 400 of the current invention is shown. The mug cap 400 is a screw cap as shown by the male threads on the lower half of the cylindrical section 470 of the cap. It is appreciated that, in another embodiment, the cap can be made to cover the tumbler's opening, and the cylindrical section of the cap's bottom is female threaded to match the male threads on the neck of the tumbler. The mug cap 400 comprises a lid 410 that has a bottom attachment 420, usually made of silicone. It is appreciated that the bottom 420 can be attached to the lid 410 by a variety of fastening methods. As disclosed, the bottom of the bottom 420, not shown in this figure, has a protruding tab that is used to plug the sipper opening 471. The cap 400 further comprises a lever 430 to elevate or press down the built-in straw's top half 440. As disclosed, the lever 430 comprises an L-shaped component 431, whose back is attached to the top of a whistle-shaped component 432. The whistle-shaped component 432 has no bottom, and, on its side walls, there are slots 433 that engage the protruding tabs or pins 441 on the sides of the straw's top half 440. As disclosed, the slots 433 and protruding tabs 441 form a pin-in-a-slot mechanism to elevate or press down the straw's top half 440 as the lever 430 swings up or down, respectively. The straw's top half 440 has a whistle shape, but elongated. The significance of the circular lower end will be disclosed in the next figure, FIG. 5. The tube of the straw is longitudinally disposed inside this component. The cap further comprises a seal O-ring 450 and a vent screw 460 that has a deep hole in the center. The vent screw 460 is disposed at the bottom of the smaller inner recess 474, and through the cap's top, to provide a vent for the built-in straw. The O-ring 450 seals any gaps between the lower end of the straw's top half and the second opening of the cap. It is appreciated that the O-ring and screw are usually made of silicone, but could be made of other elastic materials. As disclosed, the cap 400 also comprises a cylindrical segment 472 whose top rim is raised up to form a hollow cylindrical segment 470. The outer wall of the cylindrical segment 472 is male threaded to screw into the tumbler opening. There are molded non-slip ribs on the outer wall of the hollow cylindrical segment 470. The cylindrical segment 472 further comprises a top that in turn comprises a larger outer recess 473, and a smaller inner recess 474. The larger outer recess 473 is the compartment for the lid 410, and the smaller inner recess 474 is the compartment for the built-in straw's top half 440 when they are in the closed positions. The inner walls of the recesses have other small recesses for two hole-and-pen hinges. As disclosed foregoingly, one hinge in the outer recess 473 is for the lid 410, and the second hinge in the inner recess 474 is for the straw's top half 440 and the lever 430 to swing up and down. The cap 400 further comprises a O-ring 480 which is disposed on the rim of the tumbler between the tumbler and the cap. The O-ring is usually made of silicone, or other elastic materials. It seals any gaps exist between the rim of the tumbler and the underside of the cap 400. The cap 400 further comprises a bottom half 490 of the built-in straw. The straw's bottom half 490 is inserted into a tube fused to the underside of the cap and connect to the second opening. The straw snugly fits the tube's opening, and the friction between the straw and tube holds the straw in place.

Figure 5:
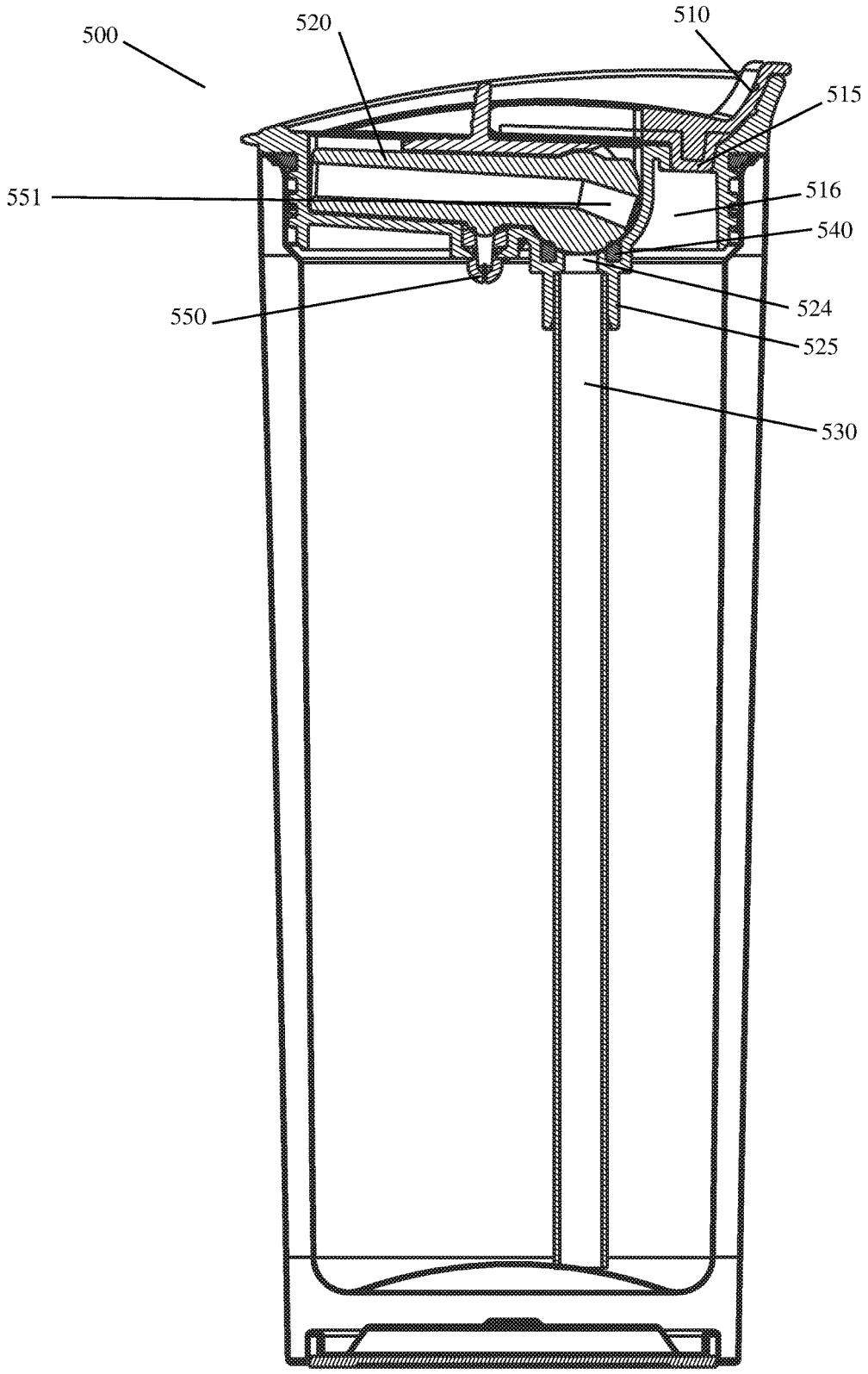
FIG. 5 is a cross section view of a multifunctional mug cap, fully assembled and in a closed position.

Referring to FIG. 5, a cross section view of a fully assembled and closed mug 500 is shown. This cross section view further discloses the inner working of the mug cap. The cap comprises, among other foregoing disclosed components, two openings and the functions of the plug and seal components of the mug cap. As disclosed in FIGS. 1-4 and their descriptions, the mug cap comprises a lid 510 that has a silicone protruding tab 515 on the bottom. When the lid is closed, the tab 515 plugs the sipper opening 516. The built-in straw's top half 520 when elevated has its lower end opening 551 aligned with a second opening 524 of the cap. The straw's bottom half 530 is disposed under the cap, and its top end opening connects to the opening 524 by a cylindrical segment 525 that is attached to the underside of the cap where the opening 524 is. The top end of the straw's bottom half 530 is inserted snugly into the cylindrical segment 525, and stays on due to friction. The diameters of the straw's bottom half 530 and the cylindrical segment 525 are larger than that of the second opening 524. Around the top rim of the second opening 524, there is a groove for the O-ring 540. As disclosed, the straw's top half has an elongated whistle shape. The circular lower end of the straw's top half is designed to sit snugly on top the O-ring 540, and, together with the O-ring, seal the second opening 524. It is appreciated that the lower end of the straw's top half is round, so that wherever position of the straw's top half, closed or open, the round lower end always sits snugly on top of the O-ring, and seals the second opening 524. For the built-in straw to work, the cap needs a vent, and vent screw 550 provides a vent hole.

The invention claimed is:

1. A tumbler apparatus comprising a mug cap and a tumbler wherein said mug cap comprises a cylindrical section having an upper section and a lower section wherein said lower section comprises male threads along its outer perimeter and said tumbler having female threads along its inner perimeter and further comprises a lower straw apparatus; said lower straw apparatus comprises an opening and a straw attached to said opening; said upper section comprises a primary opening and a sipper opening, a top half straw apparatus, a lever and a lid;

said lid is comprised of a protruding tab and a base, said lid's base is attached to a perimeter of said primary opening providing a pivot for the lid to switch between closed and open configurations and when in the closed configuration said protruding tab seals said sipper opening; said top half straw apparatus comprising a cylindrical body with a hallow section inside said cylindrical body having a first opening near its proximal end and a second opening near its distal end; said cylindrical body further having an attachment device near its proximal end where said attachment device attaches said top half straw apparatus to said primary opening and provides pivot for said top half straw apparatus to switch between the closed and open configurations wherein when said top half straw apparatus is in its open configuration its first opening matches said opening of said straw of said lower straw apparatus and wherein when said top half straw apparatus is in its closed configuration neither its first or second openings match said opening of said lower straw;

wherein said lever is connected to said top half straw apparatus and pivoted on a pivot that is parallel to that of said top half straw apparatus.

* * * * *